US009910386B2

(12) United States Patent
Sasaki

(10) Patent No.: US 9,910,386 B2
(45) Date of Patent: Mar. 6, 2018

(54) DEVELOPING DEVICE AND IMAGE FORMING APPARATUS INCLUDING THE SAME

(71) Applicant: KYOCERA Document Solutions Inc., Osaka (JP)

(72) Inventor: Yu Sasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/625,448

(22) Filed: Jun. 16, 2017

(65) Prior Publication Data

US 2018/0011424 A1 Jan. 11, 2018

(30) Foreign Application Priority Data

Jul. 5, 2016 (JP) ..... 2016-133234

(51) Int. Cl.
*G03G 15/08* (2006.01)

(52) U.S. Cl.
CPC ..... *G03G 15/0889* (2013.01); *G03G 15/0865* (2013.01); *G03G 15/0836* (2013.01); *G03G 15/0887* (2013.01); *G03G 15/0893* (2013.01); *G03G 2215/0802* (2013.01); *G03G 2215/0819* (2013.01); *G03G 2215/0822* (2013.01); *G03G 2215/0827* (2013.01)

(58) Field of Classification Search
CPC ..... G03G 15/0836; G03G 15/0865; G03G 15/0887; G03G 15/0889; G03G 15/0893; G03G 2215/0802; G03G 2215/0819; G03G 2215/0822; G03G 2215/0827; G03G 2215/083; G03G 2215/0833
See application file for complete search history.

(56) References Cited

U.S. PATENT DOCUMENTS

2012/0099899 A1* 4/2012 Kuramoto ..... G03G 15/0822 399/254
2016/0216640 A1* 7/2016 Nose ..... G03G 15/0891
2016/0259269 A1* 9/2016 Tanaka ..... G03G 15/0893

FOREIGN PATENT DOCUMENTS

JP 2013-25123 A 2/2013

* cited by examiner

*Primary Examiner* — Joseph S Wong
(74) *Attorney, Agent, or Firm* — Stein IP, LLC

(57) ABSTRACT

A developing device includes a developing container and a second stirring member. The developing container includes a second feeding chamber and a developer discharge outlet disposed on the downstream side end of the second feeding chamber. The second stirring member includes a second feeding blade, a restricting part for conveying developer in the opposite direction to the second feeding blade, and a discharging blade for conveying the developer in the same direction as the second feeding blade so as to discharge the developer from the developer discharge outlet. The second rotation shaft includes a large shaft diameter part provided with the second feeding blade, a small shaft diameter part provided with the restricting part and the discharging blade, and a shaft diameter changing part positioned at a boundary between the large shaft diameter part and the small shaft diameter part.

7 Claims, 5 Drawing Sheets

COMPARATIVE EXAMPLE

DEVELOPING DEVICE AND IMAGE FORMING APPARATUS INCLUDING THE SAME

INCORPORATION BY REFERENCE

This application is based upon and claims the benefit of priority from the corresponding Japanese Patent Application No. 2016-133234 filed Jul. 5, 2016, the entire contents of which are hereby incorporated by reference.

BACKGROUND

The present disclosure relates to a developing device used in an image forming apparatus utilizing an electrophotographic process, such as a copier, a printer, a facsimile machine, or a multifunction peripheral thereof, and to an image forming apparatus including the developing device. In particular, the present disclosure relates to a developing device that replenishes two-component developer containing toner and carrier and discharges excessive developer, and to an image forming apparatus including the developing device.

In the image forming apparatus, a latent image is formed on an image carrier such as a photoreceptor, and the developing device develops and visualizes the latent image into a toner image. One of such developing devices adopts a two-component developing method using two-component developer. In this type of developing device, two-component developer (hereinafter also referred to simply as developer) containing carrier and toner is stored in a developing container, a developing roller is disposed for supplying developer to the image carrier, and a stirring member is disposed for conveying and stirring the developer in the developing container so as to supply the developer to the developing roller.

In this developing device, the toner is consumed by the developing operation while the carrier is not consumed and remains in the developing device. Therefore, the carrier, which is stirred with the toner in the developing container, is deteriorated along with an increase in stirring frequency, and as a result, electrification performance of the carrier to the toner is gradually deteriorated.

Therefore, there is known a developing device that replenishes developer containing carrier into the developing container and discharges excessive developer, so as to prevent deterioration of electrification performance.

For example, as for a system for replenishing carrier and toner into a developing container, there is known a developing device in which a stirring member includes a first feeding portion for feeding developer in a developing container, a second feeding portion disposed on the downstream side in the feeding direction of the first feeding portion and constituted of an opposite spiral blade for feeding the developer in the opposite direction to the first feeding portion, and a third feeding portion disposed on the upstream side in the feeding direction of the second feeding portion so as to feed the developer in the same direction as the first feeding portion and to discharge the developer from a developer discharge outlet.

With this developing device including the first feeding portion, the second feeding portion, and the third feeding portion, when the developer is replenished into the developing container, the developer is stirred and fed to the downstream side in a feeding chamber by rotation of the first feeding portion. When the opposite spiral blade of the second feeding portion rotates in the same direction as the first feeding portion, a feeding force in the opposite direction to the feeding direction of the first feeding portion is applied to the developer. This feeding force in the opposite direction stops the developer and makes it bulky, and hence excessive developer overflows the second feeding portion, moves to the developer discharge outlet, and is externally discharged.

In addition, in the developing device including the first feeding portion, the second feeding portion, and the third feeding portion, the developer discharge outlet has an inner diameter smaller than the feeding chamber, and a rotation shaft of the stirring member is formed to have a diameter decreasing toward the developer discharge outlet at a boundary part between the feeding chamber and the developer discharge outlet.

SUMMARY

A developing device according to one aspect of the present disclosure includes a developing container, a first stirring member, a second stirring member, and a developer carrier. The developing container includes a plurality of feeding chambers including a first feeding chamber and a second feeding chamber disposed in parallel to each other, communicating parts for communicating the first feeding chamber and the second feeding chamber at both ends in the longitudinal direction of the first feeding chamber and the second feeding chamber, a developer replenishment port for replenishing developer, and a developer discharge outlet disposed on a downstream side end in the second feeding chamber for discharging excessive developer. The developing container stores two-component developer containing carrier and toner. The first stirring member is constituted of a first rotation shaft and a first feeding blade formed on the outer circumference surface of the first rotation shaft, so as to stir and feed the developer in the first feeding chamber in an axial direction of the first rotation shaft. The second stirring member is constituted of a second rotation shaft and a second feeding blade formed on the outer circumference surface of the second rotation shaft, so as to stir and feed the developer in the second feeding chamber in the opposite direction to the first stirring member. The developer carrier is supported by the developing container in a rotatable manner so as to carry the developer in the second feeding chamber on the surface thereof. The second stirring member includes a restricting part and a discharging blade. The restricting part is formed on the downstream side of the second feeding blade in a developer feeding direction in the second feeding chamber, and is constituted of a feeding blade for feeding the developer in the second feeding chamber in the opposite direction to the second feeding blade. The discharging blade is formed on the downstream side of the restricting part in the developer feeding direction in the second feeding chamber, so as to feed the developer in the same direction as the second feeding blade and to discharge the developer from the developer discharge outlet. The developer discharge outlet has an inner diameter smaller than that of the second feeding chamber. The second rotation shaft includes a large shaft diameter part provided with the second feeding blade, a small shaft diameter part having a diameter smaller than that of the large shaft diameter part, the small shaft diameter part being provided with the restricting part and the discharging blade, and a shaft diameter changing part positioned at a boundary between the large shaft diameter part and the small shaft diameter part.

Still other objects of the present disclosure and specific advantages obtained by the present disclosure will become apparent from the description of an embodiment given below.

DETAILED DESCRIPTION

Figure 1:
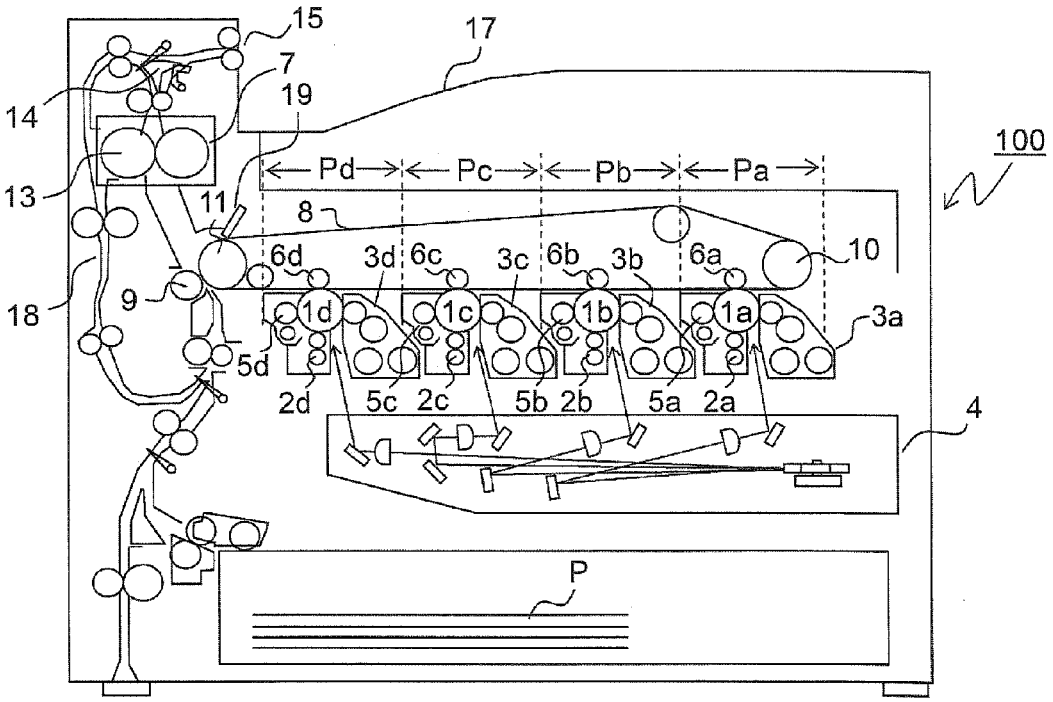
FIG. 1 is a schematic cross-sectional view of an image forming apparatus 100 equipped with developing devices 3*a* to 3*d* of the present disclosure.

Hereinafter, an embodiment of the present disclosure is described with reference to the drawings. FIG. 1 is a schematic cross-sectional view of an image forming apparatus 100 equipped with developing devices 3*a* to 3*d* of the present disclosure, and illustrates a tandem type color printer. Inside a main body of the image forming apparatus 100, there are four image forming units Pa, Pb, Pc, and Pd disposed in this order from a feeding direction upstream side (i.e. right side in FIG. 1). These image forming units Pa to Pd are provided so as to support four different colors (cyan, magenta, yellow, and black) of images, so as to sequentially form cyan, magenta, yellow, and black images by electrifying, exposing, developing, and transferring steps.

These image forming units Pa to Pd respectively include photosensitive drums 1*a*, 1 *b*, 1*c*, and 1*d* for carrying visual images (toner images) of individual colors. Further, an intermediate transfer belt 8 is disposed adjacent to the image forming units Pa to Pd and are driven by a drive unit (not shown) in a clockwise direction in FIG. 1. The toner images formed on these photosensitive drums 1*a* to 1*d* are sequentially transferred onto the intermediate transfer belt 8 that moves while contacting with the photosensitive drums 1*a* to 1*d*, and then are transferred onto a transfer paper sheet P at one time with a secondary transfer roller 9. Further, a fixing unit 7 fixes the toner images to the transfer paper sheet P, and then the transfer paper sheet P is discharged from the apparatus main body. The photosensitive drums 1*a* to 1*d* are rotated in a counterclockwise direction in FIG. 1, while the image forming process is performed in each of the photosensitive drums 1*a* to 1*d*.

The transfer paper sheets P to which the toner images are transferred are stored in a paper sheet cassette in a lower part of the main body of the image forming apparatus 100, and are conveyed to the secondary transfer roller 9 by a paper feed roller and a registration roller pair. In addition, on the downstream side of the secondary transfer roller 9, there is disposed a blade-like belt cleaner 19 for removing toner remaining on the surface of the intermediate transfer belt 8.

Next, the image forming units Pa to Pd are described. Around and below the photosensitive drums 1*a* to 1*d* disposed in a rotatable manner, there are disposed charging units 2*a*, 2*b*, 2*c* and 2*d* for charging the photosensitive drums 1*a* to 1*d*, an exposing unit 4 for exposing the photosensitive drums 1*a* to 1*d* with image information, the developing devices 3*a*, 3*b*, 3*c*, and 3*d* for forming toner images on the photosensitive drums 1*a* to 1*d*, and cleaning units 5*a*, 5*b*, 5*c*, and 5*d* for removing developer (toner) remaining on the photosensitive drums 1*a* to 1*d*.

When start of image formation is instructed from a host device such as a personal computer, the charging units 2*a* to 2*d* first charge the surfaces of the photosensitive drums 1*a* to 1*d* uniformly. Next, the exposing unit 4 emits light so as to form electrostatic latent images on the photosensitive drums 1*a* to 1*d* in accordance with image signals. The developing devices 3*a* to 3*d* are filled with cyan, magenta, yellow, and black color toners, respectively, at predetermined amounts by a replenishment device (not shown). These toners are supplied to the photosensitive drums 1*a* to 1*d* by the developing devices 3*a* to 3*d* and adhere to the same in an electrostatic manner, so that the toner images are formed corresponding to the electrostatic latent images formed by exposure by the exposing unit 4.

Further, an electric field of a predetermined transferring voltage is applied to the intermediate transfer belt 8, and then the cyan, magenta, yellow, and black toner images on the photosensitive drums 1*a* to 1*d* are transferred to the intermediate transfer belt 8 by primary transfer rollers 6*a* to 6*d*. After that, the toners remaining on the surfaces of the photosensitive drums 1*a* to 1*d* are removed by the cleaning units 5*a* to 5*d* so as to prepare for new formation of electrostatic latent images that will be performed next.

The intermediate transfer belt 8 is stretched around a plurality of rollers including a transport roller 10 on the upstream side and a drive roller 11 on the downstream side. When the intermediate transfer belt 8 starts to turn in the clockwise direction along with rotation of the drive roller 11 driven by a drive motor (not shown), the transfer paper sheet P is conveyed to the secondary transfer roller 9 disposed adjacent to the intermediate transfer belt 8 at a predetermined timing, so that a full color image is transferred. The transfer paper sheet P to which the toner image is transferred is conveyed to the fixing unit 7.

The transfer paper sheet P conveyed to the fixing unit 7 is heated and pressed by a fixing roller pair 13 so that the toner image is fixed to the surface of the transfer paper sheet P, and hence a predetermined full color image is formed. The transfer paper sheet P with the formed full color image is distributed to one of conveying directions by a branch part 14 branching in a plurality of directions. If the image is formed only on one side of the transfer paper sheet P, the transfer paper sheet P is discharged onto a discharge tray 17 by a discharge roller pair 15 as it is (or after being conveyed to a reverse conveying path 18 and being duplex printed).

Figure 2:
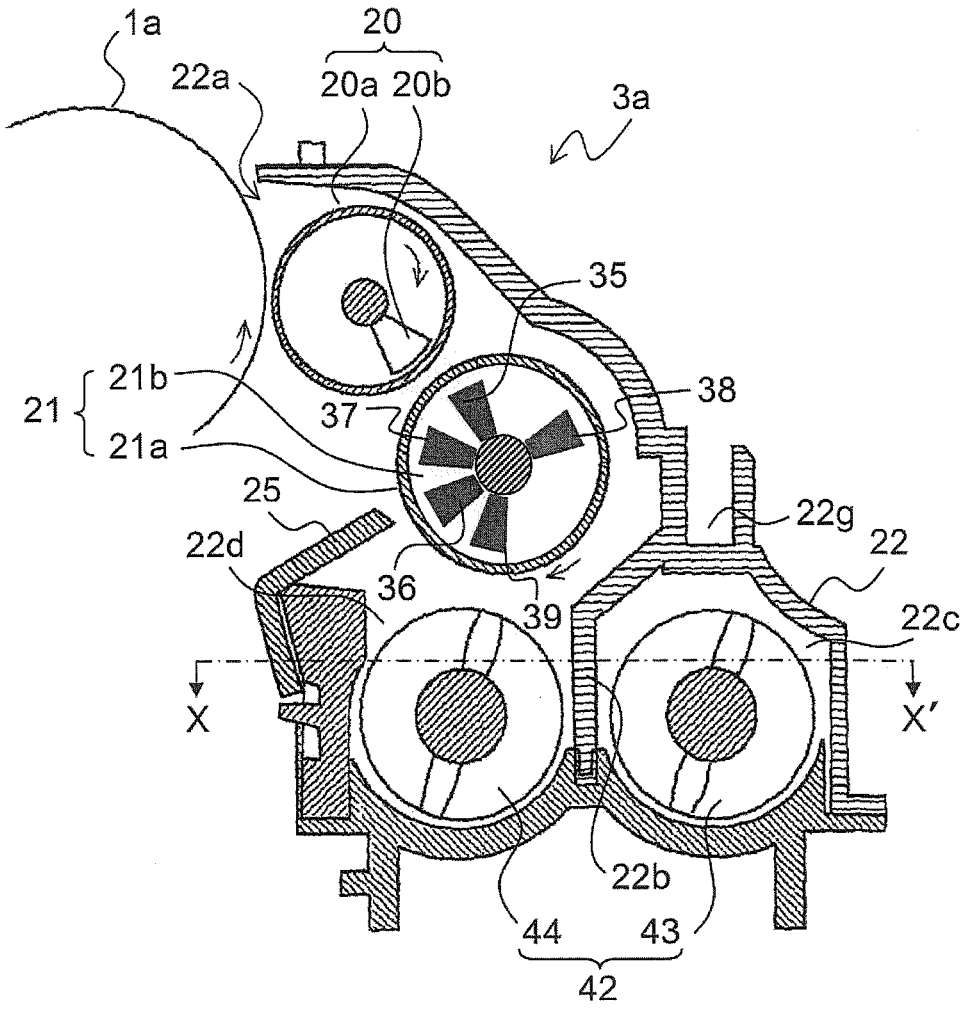
FIG. 2 is a cross-sectional side view of the developing device 3*a* according to one embodiment of the present disclosure.

FIG. 2 is a cross-sectional side view illustrating a structure of the developing device 3*a* mounted in the image forming apparatus 100. Note that, though the developing device 3*a* mounted in the image forming unit Pa of FIG. 1 is described here, the developing devices 3*b* to 3*d* mounted in the image forming units Pb to Pd have basically the same structure as the developing device 3*a*, and hence description thereof is omitted.

As illustrated in FIG. 2, the developing device 3*a* includes a developing container 22 storing two-component developer. The developing container 22 has an opening 22*a* that exposes a developing roller 20 to face the photosensitive drum, and is divided into first and second feeding chambers 22*c* and 22*d* by a partition wall 22*b*. In the first and second feeding chambers 22*c* and 22*d*, there are disposed stirring members 42 including a first stirring screw (first stirring member) 43 and a second stirring screw (second stirring member) 44 in a rotatable manner, for mixing and stirring toner (positively charged toner) and carrier supplied from a toner container (not shown) so as to be charged.

Further, the first stirring screw 43 and the second stirring screw 44 stir the developer and convey the same in an axial direction, so that the developer circulates between the first and second feeding chambers 22*c* and 22*d* through communicating parts 22*e* and 22*f* (see FIG. 3) formed on both ends of the partition wall 22*b*. In the illustrated example, the developing container 22 extends diagonally to the upper left. In the developing container 22, a magnetic roller (developer carrier) 21 is disposed above the second stirring screw 44, and the developing roller 20 is disposed at the upper left of the magnetic roller 21 to face the same. Further, the developing roller 20 faces the photosensitive drum 1*a* on the opening 22*a* side of the developing container 22 (left side of FIG. 2), and the magnetic roller 21 and the developing roller 20 rotate in the clockwise direction in FIG. 2.

Note that a toner density sensor (not shown) is disposed to face the first stirring screw 43 in the developing container 22, and toner is replenished into the developing container 22 via a developer replenishment port 22*g* from a replenishment device (not shown) in accordance with toner density detected by the toner density sensor.

The magnetic roller 21 is constituted of a non-magnetic rotation sleeve 21*a* and a fixed magnet 21*b* having a plurality of magnetic poles included in the rotation sleeve 21*a*. In this embodiment, the fixed magnet 21*b* has five magnetic poles including a main pole 35, a restricting pole (ear-cutting magnetic pole) 36, a carrying pole 37, a separating pole 38, and a draw-up pole 39. The magnetic roller 21 and the developing roller 20 are opposed to each other with a predetermined gap at the facing position (opposed position).

In addition, an ear-cutting blade 25 is attached to the developing container 22 along the longitudinal direction of the magnetic roller 21 (direction perpendicular to the paper surface of FIG. 2), and the ear-cutting blade 25 is positioned on the upstream side of the opposed position of the developing roller 20 and the magnetic roller 21 in the rotation direction of the magnetic roller 21 (clockwise direction in FIG. 2). Further, a small clearance (gap) is formed between the edge part of the ear-cutting blade 25 and the surface of the magnetic roller 21.

The developing roller 20 is constituted of a non-magnetic developing sleeve 20*a* and a developing roller side magnetic pole 20*b* fixed in the developing sleeve 20*a*. The developing roller side magnetic pole 20*b* has a polarity different from that of the opposing magnetic pole (main pole) 35 of the fixed magnet 21*b*.

As described above, the developer is stirred by the first stirring screw 43 and the second stirring screw 44, and circulates in the developing container 22, so that the toner is charged. Then, the second stirring screw 44 conveys the developer to the magnetic roller 21. The ear-cutting blade 25 faces the restricting pole 36 of the fixed magnet 21*b*, and hence by using a non-magnetic material or a magnetic material having a polarity different from that of the restricting pole 36 as the ear-cutting blade 25, an attractive magnetic field is generated between the edge of the ear-cutting blade 25 and the rotation sleeve 21*a*.

With this magnetic field, a magnetic brush is formed between the ear-cutting blade 25 and the rotation sleeve 21*a*. Further, a thickness of the magnetic brush on the magnetic roller 21 is restricted by the ear-cutting blade 25. After that, the magnetic brush moves to a position facing the developing roller 20 and is applied with the attractive magnetic field by the main pole 35 of the fixed magnet 21*b* and the developing roller side magnetic pole 20*b*. Thus, the magnetic brush contacts with the surface of the developing roller 20. Further, a thin layer of toner is formed on the developing roller 20 by a potential difference between a DC bias applied to the magnetic roller 21 and a DC bias applied to the developing roller 20, and by the magnetic field.

The thin layer of toner formed on the developing roller 20 by the magnetic brush is conveyed to opposed parts of the photosensitive drum 1*a* and the developing roller 20 by rotation of the developing roller 20, and a potential difference between the developing roller 20 and the photosensitive drum 1*a* causes the toner to fly so that the electrostatic latent image on the photosensitive drum 1*a* is developed.

Further, when the rotation sleeve 20*a* rotates in the clockwise direction, a magnetic field in the horizontal direction (roller circumferential direction) generated by the separating pole 38 having a different polarity adjacent to the main pole 35 separates the magnetic brush from the surface of the developing roller 20, and the toner remaining without being used for development is collected onto the rotation sleeve 21*a* from the developing roller 20. Further, when the rotation sleeve 21*a* rotates, a repulsive magnetic field is applied to the toner by the separating pole 38 and the draw-up pole 39 having the same polarity as the separating pole 38 of the fixed magnet 21*b*, and hence the toner is separated from the rotation sleeve 21*a* in the developing container 22. Further, the toner is stirred and fed by the second stirring screw 44 so as to become the two-component developer uniformly charged at an appropriate toner density, which forms the magnetic brush again on the rotation sleeve 21*a* by the draw-up pole 39 and is conveyed to the ear-cutting blade 25.

Figure 3:
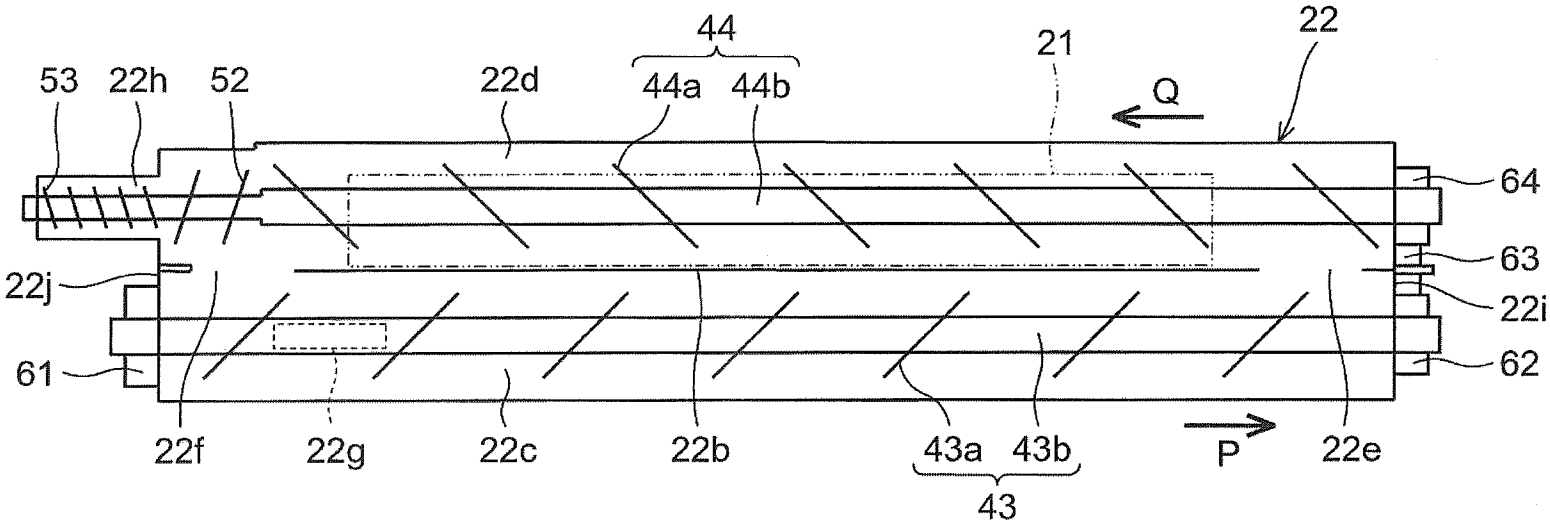
FIG. 3 is a cross-sectional plan view illustrating a stirring part of the developing device 3*a* of this embodiment.

Next, a structure of a stirring part of the developing device 3*a* is described in detail. FIG. 3 is a cross-sectional plan view illustrating the stirring part of the developing device 3*a* (cross-sectional view taken along line XX' in FIG. 2).

As described above, the first feeding chamber 22*c*, the second feeding chamber 22*d*, the partition wall 22*b*, the upstream side communicating part 22*e*, the downstream side communicating part 22*f* and the developer replenishment port 22*g* are formed in the developing container 22. Other than that, there are formed a developer discharge outlet 22*h*, an upstream side wall part 22*i*, and a downstream side wall part 22*j*. Note that in the first feeding chamber 22*c*, the left side in FIG. 3 is regarded as the upstream side, and the right side in FIG. 3 is regarded as the downstream side. In addition, in the second feeding chamber 22*d*, the right side in FIG. 3 is regarded as the upstream side, and the left side in FIG. 3 is regarded as the downstream side. Therefore, the upstream side and the downstream side of the communicating parts and the side wall parts are referred to based on the second feeding chamber 22*d*.

The partition wall 22*b* extends in the longitudinal direction of the developing container 22 so as to separate the first feeding chamber 22*c* and the second feeding chamber 22*d* to be parallel to each other. The right side end part in the longitudinal direction of the partition wall 22*b* forms the upstream side communicating part 22*e* together with an inner wall part of the upstream side wall part 22*i*, while the left side end part in the longitudinal direction of the partition wall 22*b* forms the downstream side communicating part 22*f* together with an inner wall part of the downstream side wall part 22*j*. Further, the developer can circulate in the first feeding chamber 22*c*, the upstream side communicating part 22*e*, the second feeding chamber 22*d*, and the downstream side communicating part 22*f*.

The developer replenishment port 22*g* is an opening for replenishing new toner and carrier into the developing container 22 from a developer replenishment tank (not shown) disposed above the developing container 22. The developer replenishment port 22*g* is disposed on the upstream side of the first feeding chamber 22*c* (the left side in FIG. 3).

The developer discharge outlet 22*h* is an opening for discharging excessive developer in the first and second feeding chambers 22*c* and 22*d* due to replenishment of developer. The developer discharge outlet 22*h* is formed continuously from the second feeding chamber 22*d* in the longitudinal direction on the downstream side of the second feeding chamber 22*d*.

The first stirring screw 43 is disposed in the first feeding chamber 22*c*, and the second stirring screw 44 is disposed in the second feeding chamber 22*d*.

The first stirring screw 43 includes a first rotation shaft 43*b* and a first spiral blade (first feeding blade) 43*a* formed integrally with the first rotation shaft 43*b* in a spiral shape with a constant pitch in the axial direction of the first rotation shaft 43*b*. In addition, the first spiral blade 43*a* extends to both end sides in the longitudinal direction of the first feeding chamber 22*c* so as to also face the upstream side and downstream side communicating parts 22*e* and 22*f*. The first rotation shaft 43*b* is axially supported by the upstream side wall part 22*i* and the downstream side wall part 22*j* of the developing container 22 in a rotatable manner.

The second stirring screw 44 includes a second rotation shaft 44*b* and a second spiral blade (second feeding blade) 44*a* formed integrally with the second rotation shaft 44*b* in a spiral shape with the same pitch as the first spiral blade 43*a* in the axial direction of the second rotation shaft 44*b* to be a blade in the opposite spiral direction (opposite phase) to the first spiral blade 43*a*. In addition, the second spiral blade 44*a* has a length equal to or larger than the axial direction length of the magnetic roller 21, and further is formed to extend to a position facing the upstream side communicating part 22*e*. The second rotation shaft 44*b* is disposed in parallel to the first rotation shaft 43*b* and is axially supported by the upstream side wall part 22*i* and the downstream side wall part 22*j* of the developing container 22 in a rotatable manner.

In addition, together with the second spiral blade 44*a*, a restricting part 52 and a discharging blade 53 are formed integrally with the second rotation shaft 44*b*.

The restricting part 52 is disposed in the second feeding chamber 22*d* so as to stop the developer conveyed to the downstream side in the second feeding chamber 22*d* while allowing the developer that has reached a predetermined amount or more to be conveyed to the developer discharge outlet 22*h*. The restricting part 52 is constituted of a spiral blade formed around the second rotation shaft 44*b* to be a spiral blade having the opposite spiral direction (opposite phase) to the second spiral blade 44*a*. In addition, the restricting part 52 has an outer diameter smaller than the second spiral blade 44*a* and larger than the discharging blade 53, and has a pitch smaller than that of the second spiral blade 44*a*. In addition, as for the restricting part 52, there is a predetermined clearance between the inner surface of the developing container 22 such as the downstream side wall part 22*j* and the outer periphery of the restricting part 52. The excessive developer passes through this clearance and is conveyed to the developer discharge outlet 22*h*.

The second rotation shaft 44*b* extends to the inside of the developer discharge outlet 22*h*. The second rotation shaft 44*b* inside the developer discharge outlet 22*h* is provided with the discharging blade 53. The discharging blade 53 is constituted of a spiral blade having the same spiral direction as the second spiral blade 44*a*, a pitch smaller than that of the same, and an outer diameter smaller than that of the same. Therefore, when the second rotation shaft 44*b* rotates, the discharging blade 53 also rotates. Then, the excessive developer conveyed over the restricting part 52 to the inside of the developer discharge outlet 22*h* is sent to the left side in FIG. 3 and is discharged to the outside of the developing container 22. Note that the discharging blade 53, the restricting part 52, and the second spiral blade 44*a* are molded integrally with the second rotation shaft 44*b* using synthetic resin.

On the outside wall of the developing container 22, there are disposed gears 61 to 64. The gears 61 and 62 are fixed to the first rotation shaft 43*b*, the gear 64 is fixed to the second rotation shaft 44*b*, and the gear 63 is supported by the developing container 22 in a rotatable manner so as to engage with the gears 62 and 64.

When performing development without replenishing new developer, a drive source such as a motor drives the gear 61 to rotate. Then, the first rotation shaft 43*b* and the first spiral blade 43*a* rotate, so that the developer in the first feeding chamber 22*c* is conveyed by the first spiral blade 43*a* in a direction of arrow P. After that, the developer passes through the upstream side communicating part 22*e* and is conveyed into the second feeding chamber 22*d*. Further, when the second spiral blade 44*a* rotates together with the second rotation shaft 44*b* geared with the first rotation shaft 43*b*, the developer in the second feeding chamber 22*d* is conveyed by the second spiral blade 44*a* in a direction of arrow Q. Therefore, the developer is conveyed from the first feeding chamber 22*c* into the second feeding chamber 22*d* through the upstream side communicating part 22*e* and is conveyed to the first feeding chamber 22*c* through the downstream side communicating part 22*f* without passing over the restricting part 52.

In this way, the developer is stirred while circulating the first feeding chamber 22*c*, the upstream side communicating part 22*e*, the second feeding chamber 22*d*, and the downstream side communicating part 22*f*, and thus the stirred developer is supplied to the magnetic roller 21.

Next, there is described a case where the developer is replenished from the developer replenishment port 22*g*. When the toner is consumed by development, the developer containing carrier is replenished from the developer replenishment port 22*g* into the first feeding chamber 22*c*.

The replenished developer is conveyed by the first spiral blade 43*a* in the direction of arrow P in the first feeding chamber 22*c* similarly to the case where the development is performed, and then is conveyed into the second feeding chamber 22*d* through the upstream side communicating part 22*e*. Further, the developer in the second feeding chamber 22*d* is conveyed by the second spiral blade 44*a* in the direction of arrow Q. When the restricting part 52 rotates along with rotation of the second rotation shaft 44*b*, the restricting part 52 applies a feeding force in the opposite direction (the direction of arrow P) is applied to the developer. The developer is stopped by the restricting part 52 and becomes bulky, and hence the excessive developer passes over the restricting part 52 and is discharged to the outside of the developing container 22 through the developer discharge outlet 22*h*.

Next, a structure of the developer discharge outlet 22*h* and its periphery is described in detail.

Figure 4:
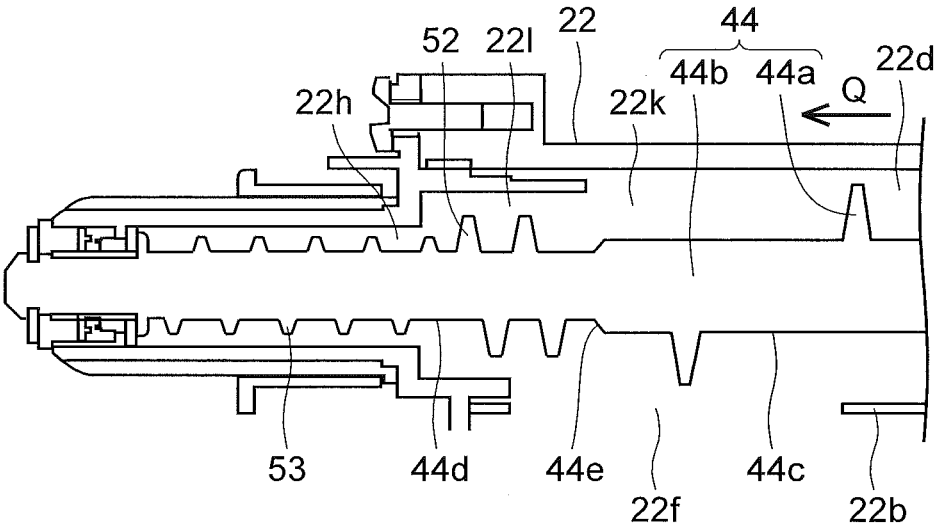
FIG. 4 is an enlarged view of a developer discharge part 22*h* and its periphery in FIG. 3.

As illustrated in FIG. 4, the second rotation shaft 44*b* includes a large shaft diameter part 44*c*, a small shaft diameter part 44*d* having a diameter smaller than that of the large shaft diameter part 44*c*, and a shaft diameter changing part 44*e* positioned at a boundary between the large shaft diameter part 44*c* and the small shaft diameter part 44*d*. The large shaft diameter part 44*c* is provided with the second spiral blade 44*a*, and the small shaft diameter part 44*d* is provided with the restricting part 52 and the discharging blade 53. In other words, the shaft diameter changing part 44*e* is positioned between the second spiral blade 44*a* and the restricting part 52.

The diameter of the small shaft diameter part 44*d* is ¾ or more of the diameter of the large shaft diameter part 44*c*. In other words, if the large shaft diameter part 44*c* has a diameter of 8 mm, for example, the diameter of the small shaft diameter part 44*d* is 6 mm or more. The shaft diameter changing part 44*e* is disposed at a position facing the downstream side communicating part 22*f* and is formed in a tapered shape having a shaft diameter gradually changing along the axial direction of the second rotation shaft 44*b*.

The second feeding chamber 22*d* includes a large inner diameter part 22*k* having a first inner diameter in which the second spiral blade 44*a* is disposed, and a small inner diameter part 22*l* having a second inner diameter smaller than the first inner diameter and larger than the inner diameter of the developer discharge outlet 22*h*, in which the restricting part 52 is disposed.

The clearance between the outer periphery of the restricting part 52 and the inner circumference surface of the small inner diameter part 22*l* is larger than the clearance between the outer periphery of the second spiral blade 44*a* and the inner circumference surface of the large inner diameter part 22*k*, and is larger than the clearance between the outer periphery of the discharging blade 53 and the inner circumference surface of the developer discharge outlet 22*h*. Note that in this embodiment, the clearance between the outer periphery of the second spiral blade 44*a* and the inner circumference surface of the large inner diameter part 22*k* is the same as the clearance between the outer periphery of the discharging blade 53 and the inner circumference surface of the developer discharge outlet 22*h*.

In this embodiment, as described above, the second rotation shaft 44*b* includes the large shaft diameter part 44*c* provided with the second spiral blade 44*a*, the small shaft diameter part 44*d* having a diameter smaller than that of the large shaft diameter part 44*c*, provided with the restricting part 52 and the discharging blade 53, and the shaft diameter changing part 44*e* positioned at the boundary between the large shaft diameter part 44*c* and the small shaft diameter part 44*d*. In this way, the shaft diameter changing part 44*e* can be positioned between the second spiral blade 44*a* and the restricting part 52, and hence it is possible to prevent the large shaft diameter part 44*c* from being positioned near the developer discharge outlet 22*h*, unlike the case where the shaft diameter changing part 44*e* is positioned between the restricting part 52 and the discharging blade 53. Therefore, it is possible to prevent decrease in the clearance between the outer circumference surface of the second rotation shaft 44*b* of the second stirring screw 44 and an opening part of the developer discharge outlet 22*h* on the upstream side, and hence it is possible to prevent condensation of the developer.

In addition, it is possible to prevent the developer from becoming hard to move to the developer discharge outlet 22*h* when flowability of the developer is deteriorated due to operating environment, toner density, deterioration of the developer, or the like, or when rotation speed of the second stirring screw 44 is lowered in a cardboard sheet feeding mode. In other words, it is possible to prevent excessive increase in the amount of developer in the developing container 22. In this way, it is possible to prevent occurrence of malfunction such as uneven resupply, an increase in rotation torque of the second stirring screw 44, or an overflow of developer.

In addition, it is possible to increase the design width of the outer diameter of the restricting part 52 (protrusion amount of the restricting part 52 from the outer circumference surface of the second rotation shaft 44*b*).

In addition, as described above, the restricting part 52 has an outer diameter smaller than the second spiral blade 44*a*. In this way, it is possible to prevent the surface area of the restricting part 52 from becoming so large that the developer feeding force in the opposite direction becomes too large.

In addition, as described above, the second feeding chamber 22*d* includes the large inner diameter part 22*k* having a first inner diameter in which the second spiral blade 44*a* is disposed, and the small inner diameter part 22*l* having the second inner diameter smaller than the first inner diameter and larger than the inner diameter of the developer discharge outlet 22*h*, in which the restricting part 52 is disposed. In this way, it is possible to prevent the clearance between the outer periphery of the restricting part 52 and the inner circumference surface of the developing container 22 from becoming too large, and hence amount of developer moving to the developer discharge outlet 22*h* can be appropriately controlled.

In addition, as described above, the diameter of the small shaft diameter part 44*d* is ¾ or larger of the diameter of the large shaft diameter part 44*c*. In this way, it is possible to prevent the diameter of the small shaft diameter part 44*d* from becoming so small that the surface area of the restricting part 52 becomes too large. Thus, it is possible to prevent an increase in rotation torque of the second stirring screw 44.

In addition, as described above, the shaft diameter changing part 44*e* is formed in a tapered shape having a shaft diameter gradually changing along the axial direction of the second rotation shaft 44*b*. In this way, because the shaft diameter of the second rotation shaft 44*b* can be gradually changed, the developer conveyed in the opposite direction by the restricting part 52 is not stuck at a step part of the shaft diameter changing part 44*e*. As a result, the developer can be smoothly conveyed at the shaft diameter changing part 44*e* and its vicinity.

Other than that, the present disclosure is not limited to the embodiment described above and can be variously modified within the scope of the present disclosure without deviating from the spirit thereof. For example, the present disclosure can be applied not only to the developing device including the magnetic roller 21 and the developing roller 20 as illustrated in FIG. 2 but also to various developing devices using two-component developer containing toner and carrier. For example, the above embodiment describes a biaxially conveying developing device including the first feeding chamber 22*c* and the second feeding chamber 22*d* disposed in parallel to each other as a developer circulation path in the developing container 22, but the present disclosure can be applied also to a triaxially conveying developing device including a collection feeding chamber for collecting the developer removed from the magnetic roller 21 and supplying the same to the second feeding chamber 22*d*.

In addition, the embodiment described above uses the first stirring screw 43 and the second stirring screw 44, in which the first spiral blade 43*a* and the second spiral blade 44*a* are continuously formed on the outer circumference surfaces of the first rotation shaft 43*b* and the second rotation shaft 44*b*, respectively. However, the feeding blade for conveying the developer is not limited to the spiral blade. For example, it is possible to use a stirring feeding member including a plurality of semicircular plates (half disks) arranged on the outer circumference surface of the first rotation shaft 43*b* and the second rotation shaft 44*b* alternately at a predetermined inclination angle.

In addition, the present disclosure can be applied not only to the tandem type color printer illustrated in FIG. 1 but also to any other image forming apparatus using a two-component developing method, such as a digital or analog monochrome copier, monochrome printer, color copier, or facsimile machine. Hereinafter, effects of the present disclosure are described with reference to Example.

EXAMPLE

In the image forming apparatus 100 as illustrated in FIG. 1, variation in the amount of developer in the developing devices 3*a* to 3*d* was checked while changing the developer feeding speed (rotation speed of the second stirring screw 44) and the toner density. Note that the test was performed using the cyan image forming unit Pa including the photosensitive drum 1*a* and the developing device 3*a*.

Figure 5:
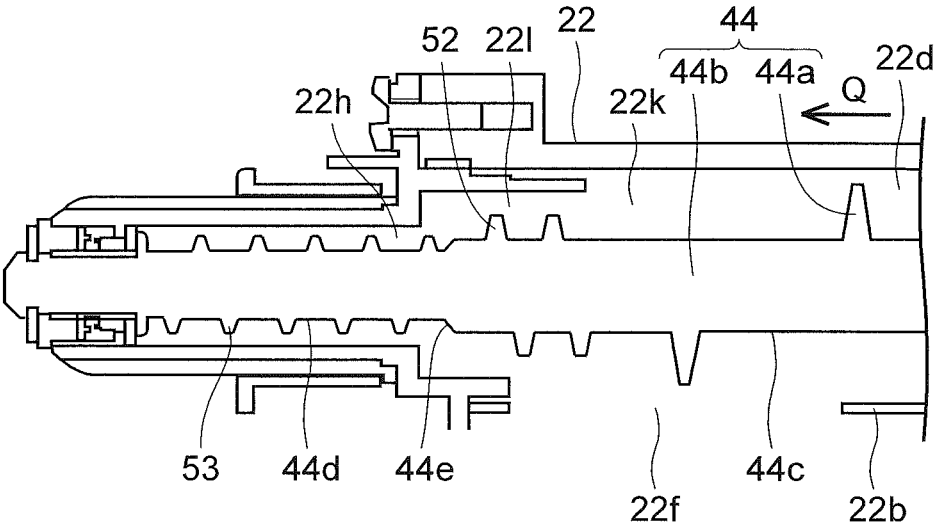
FIG. 5 is an enlarged view of the developer discharge part 22*h* and its periphery in the developing device 3*a* of a comparative example.

As a method of the test, the developing device 3*a* having the shaft diameter changing part 44*e* positioned between the second spiral blade 44*a* and the restricting part 52 as illustrated in FIG. 4 was used as this example. In addition, the developing device 3*a* having the shaft diameter changing part 44*e* positioned between the restricting part 52 and the discharging blade 53 as illustrated in FIG. 5 was used as a comparative example.

The second spiral blade 44*a* of the second stirring screw 44 used in this example and the comparative example is a spiral blade having an outer diameter of 18 mm and a pitch of 30 mm, and the clearance between the outer periphery of the second spiral blade 44*a* and the inner circumference surface of the large inner diameter part 22*k* is 1.0 mm. In addition, the restricting part 52 is constituted of two spiral blades of the opposite spiral direction (opposite phase) having an outer diameter of 12 mm and a pitch of 5 mm, and the clearance between the outer periphery of the restricting part 52 and the inner circumference surface of the small inner diameter part 22*l* is 1.5 mm. The discharging blade 53 is a spiral blade having an outer diameter of 8 mm and a pitch of 5 mm, and the clearance between the outer periphery of the discharging blade 53 and the inner circumference surface of the developer discharge outlet 22*h* is 1.0 mm. The large shaft diameter part 44*c* has a diameter of 8 mm, and the small shaft diameter part 44*d* has a diameter of 6 mm.

The developing containers 22 of the developing devices 3*a* of this example and the comparative example were filled with 350 grams of developer containing positively charged toner and ferrite carrier each having an average grain size of 6.7 μm, the developer was stirred and conveyed while changing the rotation speed of the first stirring screw 43 and the second stirring screw 44, and when discharge of the developer from the developer discharge outlet 22*h* subsided, the amount of developer in the developing container 22 (stable volume) was measured.

As a method of measuring the amount of developer, the developing device 3*a* of this example or the comparative example was mounted in the test apparatus, the developer was stirred under normal temperature and normal humidity environment (25° C., 50%) while changing the rotation speed of the second stirring screw 44 (agitating speed in the second feeding chamber 22*d*) and the toner density (T/C), and then the developing device 3*a* was detached and the weight thereof was measured. The amount of developer was calculated by subtracting weight of vacant developing device 3*a* after removing the developer from the measured weight of the developing device 3*a*, and the stable volume was calculated by dividing the calculated amount of developer by bulk density. The agitating speed was changed in four steps of 150 rpm, 240 rpm, 330 rpm, and 420 rpm, and the toner density was changed in three steps of 5%, 8%, and 11%.

Figure 6:
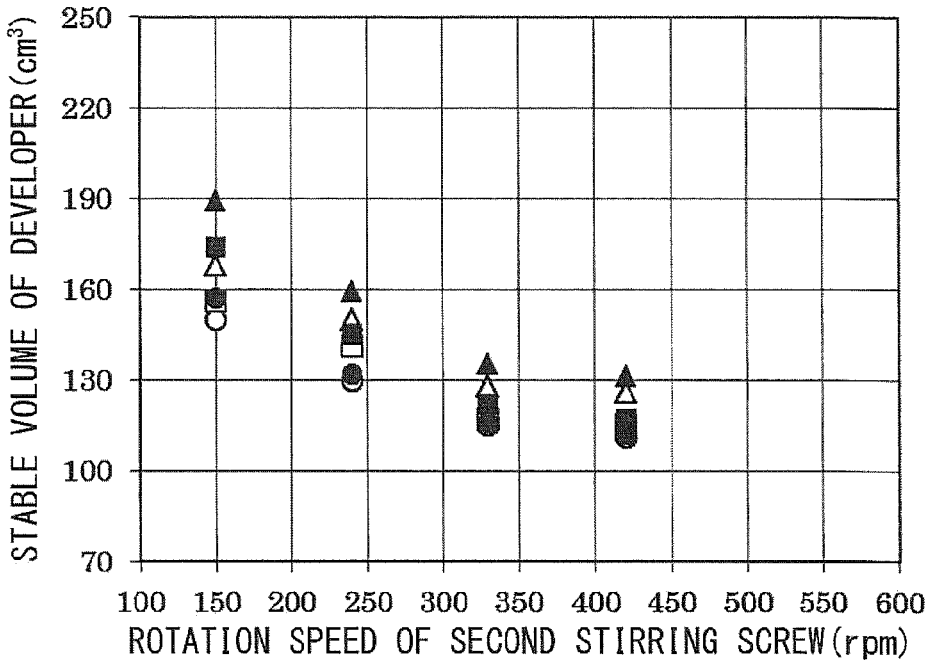
FIG. 6 is a graph showing variation in the amount of developer in the developing devices 3*a* to 3*d* when developer feeding speed and toner density are changed, in the developing device 3*a* having a shaft diameter changing part 44*e* positioned between a second spiral blade 44*a* and a restricting part 52 (this example), and in the developing device 3*a* having the shaft diameter changing part 44*e* positioned between the restricting part 52 and a discharging blade 53 (the comparative example).

Note that if the toner density of the developer is different, the aerated bulk density thereof is different, and therefore the amount of developer was compared not by weight but by volume. A result of the test is shown in FIG. 6. In FIG. 6, the stable volumes in the developing device 3*a* of this example when the toner density is set to 5%, 8%, and 11% are shown as data of symbols ○, □, and Δ, respectively. In addition, the stable volumes in the developing device 3*a* of the comparative example when the toner density is set to 5%, 8%, and 11% are shown as data of symbols •, ■, ▲, respectively.

As obvious from FIG. 6, variations in the stable volume of the developer due to a difference of the agitating speed and a difference of the toner density in the developing device 3*a* of this example are smaller than those in the developing device 3*a* of the comparative example. This reason is considered as follows. In the developing device 3*a* of this example, the shaft diameter changing part 44*e* is positioned between the second spiral blade 44*a* and the restricting part 52, and hence it is prevented that the large shaft diameter part 44*c* is positioned near the developer discharge outlet 22*h* and that the clearance between the outer circumference surface of the second rotation shaft 44*b* and the inner circumference surface of the developer discharge outlet 22*h* becomes small. Therefore, the effect of stabilizing the volume of developer is obtained in both cases where the agitating speed changes and where the flowability of developer is changed due to a variation in the toner density.

From the above results, it is confirmed that in the developing device 3*a* of this example, in which the shaft diameter changing part 44*e* is positioned between the second spiral blade 44*a* and the restricting part 52, a variation in the stable volume of developer is reduced when the agitating speed of developer or the toner density is changed, and hence occurrence of image failure due to a variation in the agitating speed or the toner density can be effectively prevented. In particular, a variation in the stable volume of developer when the agitating speed is changed can be noticeably suppressed.

What is claimed is:

1. A developing device comprising:

a developing container including a plurality of feeding chambers including a first feeding chamber and a second feeding chamber disposed in parallel to each other, communicating parts for communicating the first feeding chamber and the second feeding chamber at both ends in the longitudinal direction of the first feeding chamber and the second feeding chamber, a developer replenishment port for replenishing developer, and a developer discharge outlet disposed on a downstream side end in the second feeding chamber for discharging excessive developer, the developing container storing two-component developer containing carrier and toner;

a first stirring member constituted of a first rotation shaft and a first feeding blade formed on the outer circumference surface of the first rotation shaft, so as to stir and feed the developer in the first feeding chamber in an axial direction of the first rotation shaft;

a second stirring member constituted of a second rotation shaft and a second feeding blade formed on the outer circumference surface of the second rotation shaft, so as to stir and feed the developer in the second feeding chamber in the opposite direction to the first stirring member, and a developer carrier supported by the developing container in a rotatable manner so as to carry the developer in the second feeding chamber on the surface thereof, wherein the second stirring member includes a restricting part formed on the downstream side of the second feeding blade in a developer feeding direction in the second feeding chamber, the restricting part being constituted of a feeding blade for feeding the developer in the second feeding chamber in the opposite direction to the second feeding blade, and a discharging blade formed on the downstream side of the restricting part in the developer feeding direction in the second feeding chamber, so as to feed the developer in the same direction as the second feeding blade and to discharge the developer from the developer discharge outlet, the developer discharge outlet has an inner diameter smaller than that of the second feeding chamber, and the second rotation shaft includes a large shaft diameter part provided with the second feeding blade, a small shaft diameter part having a diameter smaller than that of the large shaft diameter part, the small shaft diameter part being provided with the restricting part and the discharging blade, and a shaft diameter changing part positioned at a boundary between the large shaft diameter part and the small shaft diameter part.

2. The developing device according to claim 1, wherein the restricting part has an outer diameter smaller than the second feeding blade and larger than the discharging blade.

3. The developing device according to claim 2, wherein the second feeding chamber includes a large inner diameter part having a first inner diameter in which the second feeding blade is disposed, and a small inner diameter part having a second inner diameter smaller than the first inner diameter and larger than an inner diameter of the developer discharge outlet, the small inner diameter part in which the restricting part is disposed.

4. The developing device according to claim 3, wherein clearance between an outer periphery of the restricting part and an inner circumference surface of the small inner diameter part is larger than a clearance between an outer periphery of the second feeding blade and an inner circumference surface of the large inner diameter part.

5. The developing device according to claim 1, wherein a diameter of the small shaft diameter part is ¾ or larger of a diameter of the large shaft diameter part.

6. The developing device according to claim 1, wherein the shaft diameter changing part is formed in a tapered shape having a shaft diameter gradually changing along an axial direction of the second rotation shaft.

7. An image forming apparatus equipped with the developing device according to claim 1.

* * * * *